US010301925B2

(12) United States Patent
Kuckes et al.

(10) Patent No.: US 10,301,925 B2
(45) Date of Patent: May 28, 2019

(54) TRACKING SYSTEM FOR DRILLING BOREHOLES

(71) Applicant: Vector Magnetics, LLC, Ithaca, NY (US)

(72) Inventors: Arthur F. Kuckes, Ithaca, NY (US); Justin Armstrong, Ithaca, NY (US); Ross Fleming, Ithaca, NY (US)

(73) Assignee: Vector Magnetics, LLC, Ithaca, NY (US)

( * ) Notice: Subject to any disclaimer, the term of this patent is extended or adjusted under 35 U.S.C. 154(b) by 523 days.

(21) Appl. No.: 15/079,594

(22) Filed: Mar. 24, 2016

(65) Prior Publication Data

US 2016/0281493 A1 Sep. 29, 2016

Related U.S. Application Data

(60) Provisional application No. 62/139,358, filed on Mar. 27, 2015.

(51) Int. Cl.
*E21B 44/00* (2006.01)
*E21B 47/024* (2006.01)
*E21B 47/12* (2012.01)

(52) U.S. Cl.
CPC ..... *E21B 47/024* (2013.01)

(58) Field of Classification Search
CPC ..... E21B 47/024; E21B 7/002; E21B 17/18; E21B 47/12; E21B 7/046; E21B 7/068
See application file for complete search history.

(56) References Cited

U.S. PATENT DOCUMENTS

2003/0085059 A1* 5/2003 Kuckes ..... E21B 7/068 175/45
2005/0056463 A1* 3/2005 Aronstam ..... E21B 7/062 175/61
2005/0126022 A1* 6/2005 Hansberry ..... E21B 47/022 33/313
2011/0005838 A1* 1/2011 Granberg ..... E21B 4/14 175/61
2011/0241656 A1* 10/2011 Piemonte ..... G01C 17/38 324/207.11
2012/0259579 A1* 10/2012 Blake ..... G01C 21/16 702/151
2013/0014992 A1* 1/2013 Sharp ..... E21B 47/024 175/45

(Continued)

*Primary Examiner* — Daniel P Stephenson
(74) *Attorney, Agent, or Firm* — Brown & Michaels, PC

(57) ABSTRACT

The present invention is directed to a system that has a first sensor assembly coupled to a mobile platform that traverses a predetermined subsurface path and has an axis of motion. The first sensor assembly obtains a gravity vector of the Earth relative to the mobile platform. A second sensor assembly is disposed in substantial alignment with a predetermined position relative to the axis of motion and is characterized by a sensitivity axis. The second sensor assembly provides a sensor signal substantially corresponding to a single vector component of the Earth's rotation vector. A control system is configured to derive the path direction relative to a known direction and an inclination angle of the mobile platform relative to the surface based on the gravity vector and the single vector component of the Earth's rotation vector.

31 Claims, 8 Drawing Sheets

(56) References Cited

U.S. PATENT DOCUMENTS

| | | | | |
|---|---|---|---|---|
| 2015/0331138 | A1* | 11/2015 | Estes | G01V 3/26 324/346 |
| 2016/0032709 | A1* | 2/2016 | Ledroz | G01C 19/02 73/152.54 |
| 2016/0281493 | A1* | 9/2016 | Kuckes | E21B 47/024 |
| 2018/0045850 | A1* | 2/2018 | Smidth | G01V 99/005 |
| 2018/0128101 | A1* | 5/2018 | Ledroz | E21B 49/00 |
| 2018/0188032 | A1* | 7/2018 | Ramanandan | G01S 19/49 |

* cited by examiner

TRACKING SYSTEM FOR DRILLING BOREHOLES

CROSS-REFERENCE TO RELATED APPLICATIONS

This is application claims priority under 35 U.S.C. 119(e) to U.S. Provisional Patent Application Ser. No. 62/139,358 filed on Mar. 27, 2015, the content of which is relied upon and incorporated herein by reference in its entirety, and again, the benefit of priority under 35 U.S.C. 119(e) is hereby claimed.

BACKGROUND OF THE INVENTION

1. Field of the Invention

The present invention relates generally to determining the drilling path of a borehole, and particularly to tracking and guiding the drilling of a borehole between a specified borehole entry and exit locations.

2. Technical Background

Various well-known drilling techniques have been used to place underground transmission lines, communication lines, pipelines, etc., over, around, between or under, obstacles of various types. To traverse an obstacle, a borehole must be drilled under the obstacle from a specified entry point to a specified exit location. Subsequently, the borehole may receive, e.g., a casing that can be used as a pipeline or a "raceway" for various kinds of cables. (The cables may be configured as power transmission lines, communication lines, or the like). What is needed is a system and method that allows a borehole to be drilled along a precise path so that boreholes can be accurately placed in locations that are encumbered with one or more physical obstacles (such as buildings, rivers, streets, rail lines, airport runways, and previously placed sewer lines and underground cabling, etc.). In other words, the aforementioned obstacles make the digging of a trench impossible or prohibitively expensive.

To be more specific, when a borehole is being drilled in such locations, the drilling apparatus (creating the borehole) must be carefully controlled so that the borehole closely follows a predetermined path comprising the entry point, borehole path and the exit point (i.e., the "prescribed drilling proposal"). While the task of establishing the entry point is easy enough, the borehole must remain within a predetermined right of way as it passes under the aforementioned obstacles. Moreover, the borehole exit point (like the borehole entry point) is typically located within a precisely defined area on the opposite side of the obstacle.

In one approach that has been considered, a plurality of orthogonal gyroscope ("gyro") sensors were employed to measure the three vector components of Earth's rotation. In this approach, each gyro sensor was rotated about its rotational axis perpendicular to its axis of sensitivity. The drive unit for rotating the gyro sensors is configured so as to rotate the gyro sensors stably while maintaining a predetermined angular relationship between the input axes of gyro sensors. One drawback to this approach relates to the need for three (3) independent sensor assemblies.

In yet another approach, a gyro-sensor assembly that employs a single gyro was considered. In this approach, the gyro sensor was configured to operate in multiple sequential orientations in order to measure the vector components of Earth's rotation to compute the azimuth of the drilling apparatus. While this approach provides a more compact sensor assembly, other drawbacks become evident. For example, a single gyro sensor configured to be rotated about multiple axes requires a relatively costly and complex multi-axis gimbal apparatus. Moreover, the multiple sequential measurements by a single gyro can take an inordinate amount of time to perform. If such measurements are take every time a drill length is added, significant measurement delays will accrue resulting in a significant increase in the amount of time it takes to drill the borehole (drilling rig costs are usually paid by the hour).

What is needed, therefore, is a method and apparatus for tracking and guiding the drilling of a borehole with increased precision and accuracy. What is also needed is a method and apparatus for tracking and guiding the drilling of a borehole in a generally horizontal path that is disposed under a geographic obstacle (wherein the ground above the borehole is difficult or impossible to access). What is further needed is sensor apparatus configured to determine an azimuthal measurement by obtaining and analyzing a single-vector component of the Earth's rotation vector.

SUMMARY OF THE INVENTION

The present invention addresses the needs described above by providing a method and apparatus for tracking and guiding the drilling of a borehole with improved precision and accuracy. In one aspect, the present invention is directed to guiding a borehole that is being drilled along a generally horizontal path, between a specified borehole entry point and a predetermined exit location. The generally horizontal path may be disposed under a geographic obstacle such a river, a highway, a railroad, or an airport runway wherein the ground above the borehole is difficult or impossible to access. As described herein, the apparatus of the present invention is configured to determine an azimuthal measurement by obtaining and analyzing a single-vector component of the Earth's rotation vector.

The present invention provides a system that includes a down-hole apparatus mounted on a drill string near the drill bit is disclosed for tracking and guiding approximately horizontal borehole drilling. The down-hole portion of the apparatus consists of a single-vector component rotation sensor that is characterized by a rotatable axis of sensitivity. In one embodiment, the down-hole portion may employ a three-vector component gravity sensing module. The present invention is configured to rotate the sensitivity axis of the rotation sensor to a known angle between the borehole axis and a direction perpendicular to it. Essentially, the method of the present invention uses the single-vector component (of an Earth rotation vector measurement) and three gravity vector components (from the gravity sensing module) to determine the azimuth angle between true north and the borehole direction in the horizontal plane. (To be specific, the borehole direction refers to the projection of the borehole axis onto the horizontal plane).

Those skilled in the art will appreciate the method and apparatus of the present invention can readily and easily be adapted to the drilling guidance, tunneling guidance, guidance of mobile platforms (e.g., submersible), tracking and surveying of any or most boreholes and, thus, the present invention should not be construed as being limited to approximately horizontal boreholes.

One aspect of the present invention is a system that includes a first sensor assembly coupled to a mobile platform configured to traverse a predetermined path under a surface of the Earth and further characterized by an axis of motion corresponding to a path direction of the predetermined path. The first sensor assembly is configured to obtain a gravity vector of the Earth relative to the mobile platform.

A second sensor assembly is coupled to the first sensor and disposed in substantial alignment with a predetermined position relative to the axis of motion. The second sensor is characterized by a sensitivity axis and further configured to provide a sensor signal substantially corresponding to a single vector component of the Earth's rotation vector. A control system is coupled to the first sensor assembly and the second sensor assembly, the control system being configured to derive the path direction relative to a known direction and an inclination angle of the mobile platform relative to the surface based on the gravity vector and the single vector component of the Earth's rotation vector.

In one embodiment, the sensor signal substantially corresponds to a sensor sensitivity vector pointing in the direction of the sensitivity axis.

In one embodiment, the mobile platform is selected from a group of mobile platforms including a borehole forming apparatus, a drilling apparatus, a tunneling apparatus, and a submersible apparatus.

In one embodiment, the traversal of the predetermined path includes drilling a borehole under the surface In one version of the embodiment, the axis of motion substantially corresponds to a longitudinal axis of the borehole.

In one embodiment, the control system includes a first control system disposed at the surface of the Earth and a second control system coupled to the mobile platform.

In one version of the embodiment, the first control system and the second control system are coupled together by a telemetry system, the telemetry system being configured to transmit second data corresponding to the gravity vector and the single vector component of the Earth's rotation vector from the second control system to the first control system, the telemetry system being configured to transmit first data corresponding to mobile platform guidance data from the first control system to the second control system.

In one embodiment, the second sensor assembly includes a rotational sensor configured to be moved to a predetermined direction relative to the axis of motion, the movement to the predetermined direction including at least one rotational movement.

In one version of the embodiment, the second sensor assembly includes a positional encoding device coupled between the rotational sensor and a motor, the motor being configured to rotate the rotational sensor to a position substantially aligned with the predetermined direction based on positional data provided by the positional encoding device.

In one version of the embodiment, the at least one rotational movement includes a roll angle component.

In one embodiment, the sensor signal substantially corresponds to VR=2*(RtoV)*dot(ER, Rssd), wherein RtoV is a constant relating the sensor signal to a rotation rate of the sensitivity axis, ER is the Earth's rotation vector, Rssd is a unit vector pointing in a direction of the sensitivity axis, and dot(ER, Rssd) is a dot product configured to project ER onto Rssd.

In one embodiment, the inclination angle substantially corresponds to, Inc=a tan 2 (sqrt(gx^2+gy^2), gz), wherein term a tan 2 is the four-quadrant inverse tangent function, and gx, gy, gz correspond to three-gravity vector components of the gravity vector.

In one embodiment, the path direction substantially corresponds to an azimuth direction.

In one version of the embodiment, the azimuth direction substantially corresponds to, Az=AnRssdPerp−AbdRssdPerp, wherein the term Az substantially corresponds to an angle between the known direction and the path direction, and wherein the term AnRssdPerp substantially corresponds to an angle between the known direction and a component of the sensitivity axis, and wherein the term AbdRssdPerp substantially corresponding to an angle between the path direction and the component of the sensitivity axis, AnRssdPerp and AbdRssdPerp being substantially derived from the sensor signal.

In one embodiment, the known direction is North.

In another aspect, the present invention is directed to a method that includes: providing a mobile platform configured to traverse a predetermined path under a surface of the Earth, the mobile platform being further characterized by an axis of motion corresponding to a path direction of the predetermined path; obtaining a gravity vector of the Earth relative to the mobile platform; sensing a single vector component of the Earth's rotation vector relative to the mobile platform; providing a sensor signal substantially corresponding to the single vector component of the Earth's rotation vector; and deriving the path direction relative to a known coordinate and an inclination angle of the mobile platform relative to the surface based on the gravity vector and the single vector component of the Earth's rotation vector.

In one embodiment, the sensor signal is provided by a rotational sensor characterized by sensitivity axis, the sensor signal substantially corresponding to a sensor sensitivity vector pointing in the direction of the sensitivity axis.

In one embodiment, the mobile platform is selected from a group of mobile platforms including a borehole forming apparatus, a drilling apparatus, a tunneling apparatus, and a submersible apparatus.

In one embodiment, the traversal of the predetermined path includes drilling a borehole under the surface.

In one embodiment, the axis of motion substantially corresponds to a longitudinal axis of the borehole.

In one embodiment, the method further comprises the step of transmitting platform data corresponding to the gravity vector and the single vector component of the Earth's rotation vector from the mobile platform to a remotely located system.

In one version of the embodiment, the method further comprises the step of transmitting guidance data from the remotely located system to the mobile platform.

In one embodiment, the method further comprises the step of moving a rotational sensor to a predetermined direction relative to the axis of motion, the movement to the predetermined direction including at least one rotational movement.

In one version of the embodiment, the method further comprises the step of rotating the rotational sensor to a position substantially aligned with the predetermined direction based on positional data provided by the positional encoding device.

In one version of the embodiment, the at least one rotational movement includes a roll angle component.

In one embodiment, the sensor signal substantially corresponds to, VR=2*(RtoV)*dot(ER, Rssd), wherein RtoV is a constant relating the sensor signal to a rotation rate of the sensitivity axis, ER is the Earth's rotation vector, Rssd is a unit vector pointing in a direction of the sensitivity axis, and dot(ER, Rssd) is a dot product configured to project ER onto Rssd.

In one embodiment, the inclination angle substantially corresponds to, Inc=a tan 2 (sqrt(gx^2+gy^2), gz), wherein term a tan 2 is the four-quadrant inverse tangent function, and gx, gy, gz correspond to three-gravity vector components of the gravity vector.

In one embodiment, the path direction substantially corresponds to an azimuth direction.

In one version of the embodiment, the azimuth direction substantially corresponds to, Az=AnRssdPerp−AbdRssdPerp, wherein the term Az substantially corresponds to an angle between the known direction and the path direction, and wherein the term AnRssdPerp substantially corresponds to an angle between the known direction and a component of the sensitivity axis, and wherein the term AbdRssdPerp substantially corresponding to an angle between the path direction and the component of the sensitivity axis, AnRssdPerp and AbdRssdPerp being substantially derived from the sensor signal.

In one version of the embodiment, the known direction is north.

In one embodiment, the known direction is north.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The accompanying drawings are included to provide a further understanding of the invention, and are incorporated in and constitute a part of this specification. The drawings illustrate various embodiments of the invention and together with the description serve to explain the principles and operation of the invention.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
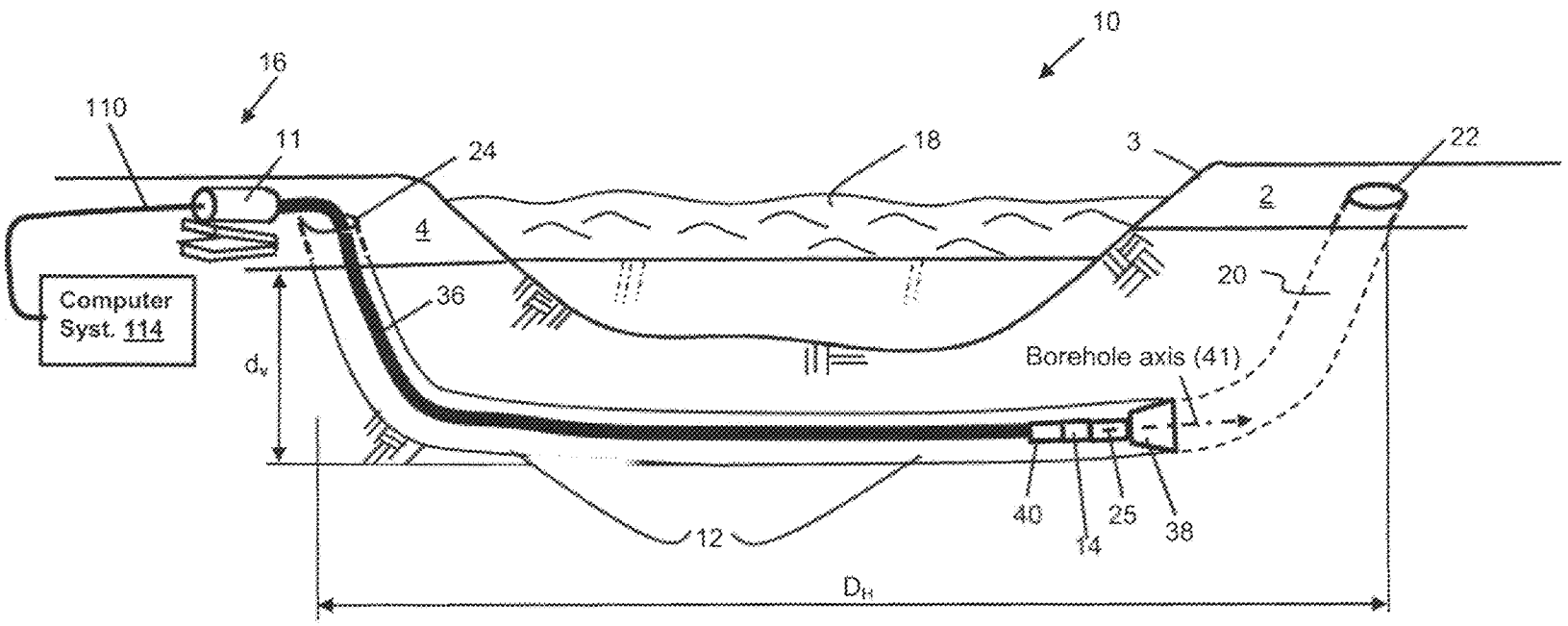
FIG. 1 is a sectional view of a generally horizontal borehole following a proposed path under the direction of the tracking system of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the tracking system of the present invention is shown in FIG. 1, and is designated generally throughout by reference numeral 10.

As embodied herein, and depicted in FIG. 1, a sectional view of a generally horizontal borehole 12 is disclosed; the borehole 12 follows a proposed path 20 under the direction of the tracking system 10 of the present invention. In this embodiment of the present invention, the system 10 is employed to guide the drilling of a borehole 12 under (or over) a physical obstacle (e.g., river 18) from a borehole entry point 24 (disposed on an entry side 4 of the obstacle) to a proposed borehole exit point 22 (disposed at the exit side 2 of the obstacle). The borehole may be used to install a pipeline, cables, or the like. The obstacle may be one or more buildings, a river 18, one or more streets, a rail line, one or more airport runways, previously placed sewer lines or previously placed underground cables, or etc. If the environment is a developed urban situation having multiple levels of infrastructure (e.g., an upper layer of telecommunication lines disposed over a sewer line or a subway line), the present invention can place the borehole between these layers.

The drilling apparatus 16 includes a conventional drill rig motor controller 11 that is coupled to a drill stem 36 that is configured to drive drill bit 38 under the river 18. The drill stem 36 is coupled to the drilling apparatus 16 at the surface in order to supply power to the drilling apparatus disposed "down-hole." The tracking system 10 is configured to guide the drilling apparatus 16 such that the drilling follows a predetermined path 20 at a predetermined vertical depth ("$d_v$") which may be, e.g., about 30 meters, to a planned exit location 22. The predetermined path may traverse a great horizontal distance ("$D_H$"), which may be, e.g., 1,000 m, 2-3 miles, etc. (Of course, the horizontal distance $D_H$ may be shorter or longer depending on the dictates of the job itself.

The system 10 includes an "uphole" system 114 that is coupled to a telemetry wire 110. The telemetry wire 110 is coupled to a tracking instrument package 40 via the drilling apparatus 16. The tracking assembly 40 is mounted on the drill stem 36 near the drilling motor 14. The drilling motor 14 is also coupled to the drill bit housing 25 and the drill bit 38. As depicted in FIG. 1, the borehole axis is also shown relative to the drill bit 38.

Figure 2:
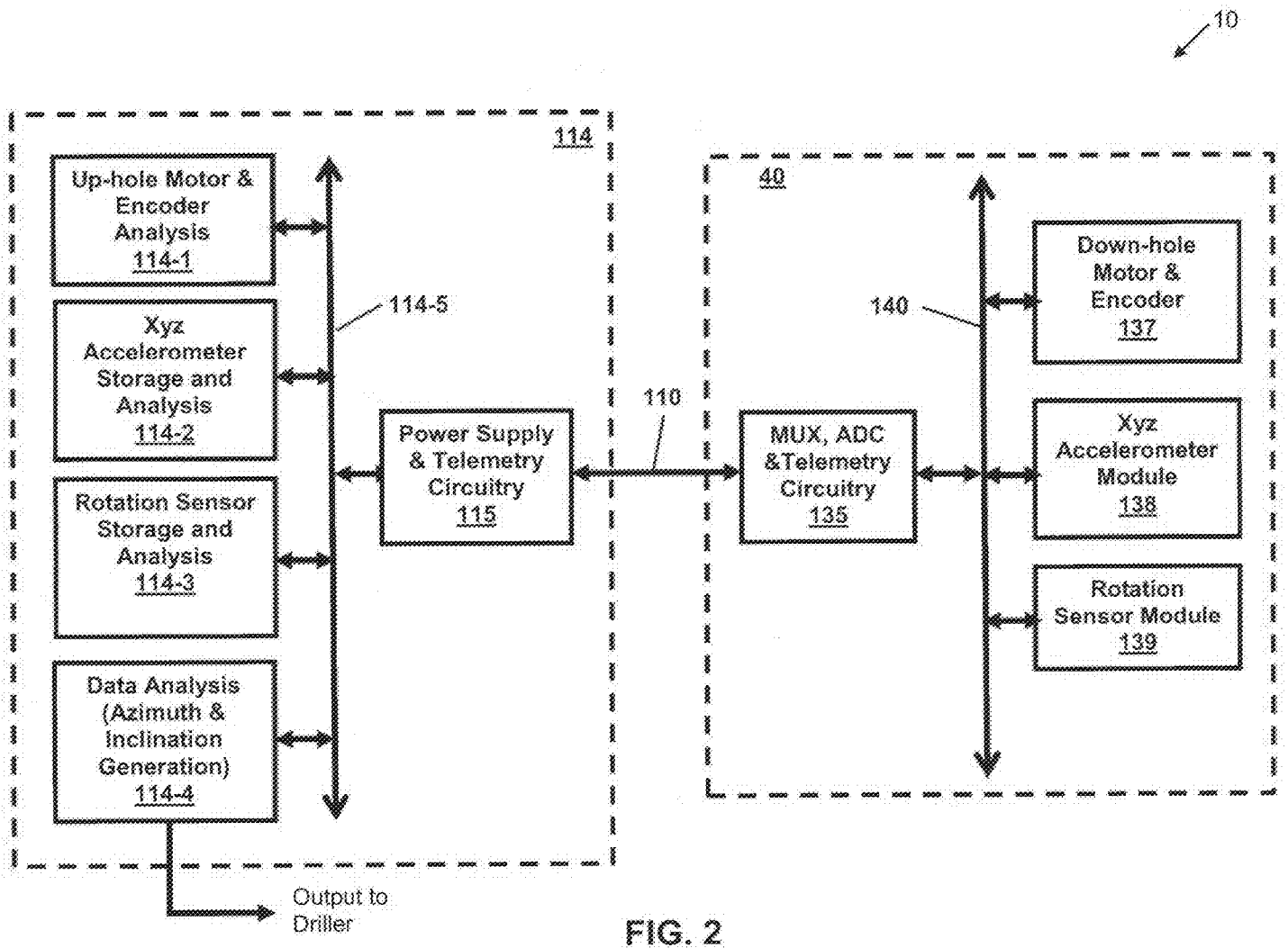
FIG. 2 is a system block diagram of the system depicted in FIG. 1 in accordance with one embodiment of the present invention.

As embodied herein, and depicted in FIG. 2, a system block diagram of the tracking system depicted in FIG. 1 is disclosed (in accordance with one embodiment of the present invention). Specifically, FIG. 2 shows the computer system 114 disposed "up-hole" (i.e., on the surface) and the tracking instrument assembly 40 disposed "down-hole." The computer system 114 is connected to the tracking instrument assembly 40 by the telemetry link 110.

The uphole computing system 114 includes instrument telemetry circuitry 115 that is coupled to the various data analysis modules (114-1 . . . 114-4) via a buss 114-5. The data analysis modules include an up-hole motor and encoder analysis module 114-1. As described herein more fully, the accelerometer module 114-2 receives and analyzes accelerometer data from downhole module 138, and the rotation sensor storage and analysis module 114-3 receives and analyzes accelerometer data from downhole module 139. The data analysis module 114-4 is configured to manipulate all of the sensor data provided by the tracking system 40 (disposed down-hole) to calculate the azimuthal direction data and the down-hole unit inclination data. This information is transmitted to the driller controller 11 (FIG. 1) so that an appropriate course correction can be made (if necessary). The instrument telemetry circuitry 115 includes a power supply configured to provide the down-hole unit 40 with a suitable DC power supply (e.g., 24 VDC). The power supply may be configured to convert and regulate power (available up-hole) from a public utility power source or from a generator. In another embodiment of the present invention, the up-hole functionality is incorporated into the downhole system 40. In this case, the azimuthal direction data, the down-hole unit inclination data and other such data are transmitted directly from the downhole tracking system 40 to the driller controller 11 via telemetry link 110.

Figure 4:
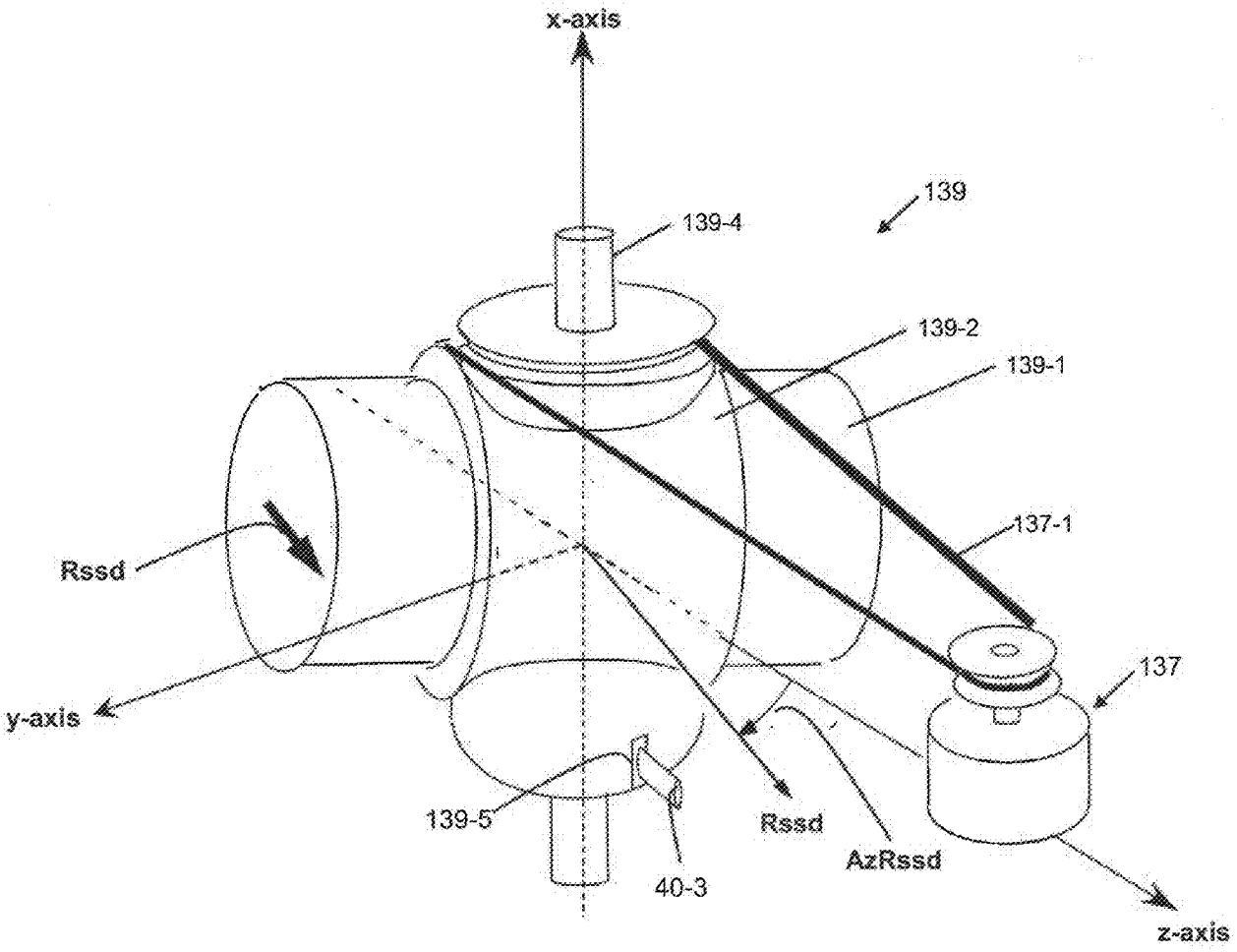
FIG. 4 is a detailed diagram of the rotational sensor module depicted in FIGS. 2 and 3.

The (down hole) tracking instrument assembly 40 includes various modules (135, 137, 138 and 139) coupled together by a bus system 140. Specifically, the tracking instrument assembly 40 includes an accelerometer module 138 that is configured to sense the three gravity direction (xyz) vector components and provide them to the accelerometer storage and analysis module 114-2 (disposed in the computer system 114) by way of the telemetry link 110. The rotation sensor module 139 is configured to sense the single vector component (of the Earth's rotation vector). To be specific, the single-vector component rotation sensor 139 is characterized by an axis of sensitivity. The motor 137 is configured to rotate the sensitivity direction Rssd of the rotation sensor 139 to a known angle (between the borehole axis 41 and a direction perpendicular to the borehole axis 41). As shown in FIG. 4, the sensitivity axis of the rotation sensor is perpendicular to the axle (x-axis) about which the rotation sensor is rotated. The single vector component voltage VR is communicated to the rotation sensor storage and analysis module 114-3 via the telemetry link 110. Those skilled in the art will appreciate that any suitable motor may be employed to implement motor 137 including a DC motor, a stepper motor, a servo-motor, or any other suitable device known to those of ordinary skill in the art. The encoder 137 may be implemented using a suitable device such as an optical, magnetic or any suitable type of encoder.

Thus, the down-hole telemetry circuit 135 is configured to communicate, inter alia, the accelerometer data and rotation sensor data to the (up-hole) instrument telemetry circuitry 115 via the telemetry link 110. In doing so, the telemetry circuitry 135 may convert the accelerometer voltage outputs and the rotation sensor voltage outputs into digital signals by an analog-to-digital converter (ADC 141). The digital signals are multiplexed in accordance with a predetermined signal format. The digital signals are then transmitted to the up-hole computer 114 via the telemetry link 110. (The accelerometer data and rotation sensor data are multiplexed so that they can be readily identified by the (up-hole) instrument telemetry circuitry 115). The data link portion of the borehole telemetry link 110 may be implemented using any suitable means. For example, it may be configured to transmit data between the up-hole unit 114 and the down-hole unit 40 using, for example, digital (or analog) signals transmitted via wireline installed within the drill pipe, modulating drilling fluid pressure pulses, digital (or analog) signals transmitted via electric current pulses flowing on the drill stem itself, or other suitable data transmission techniques.

Figure 3:
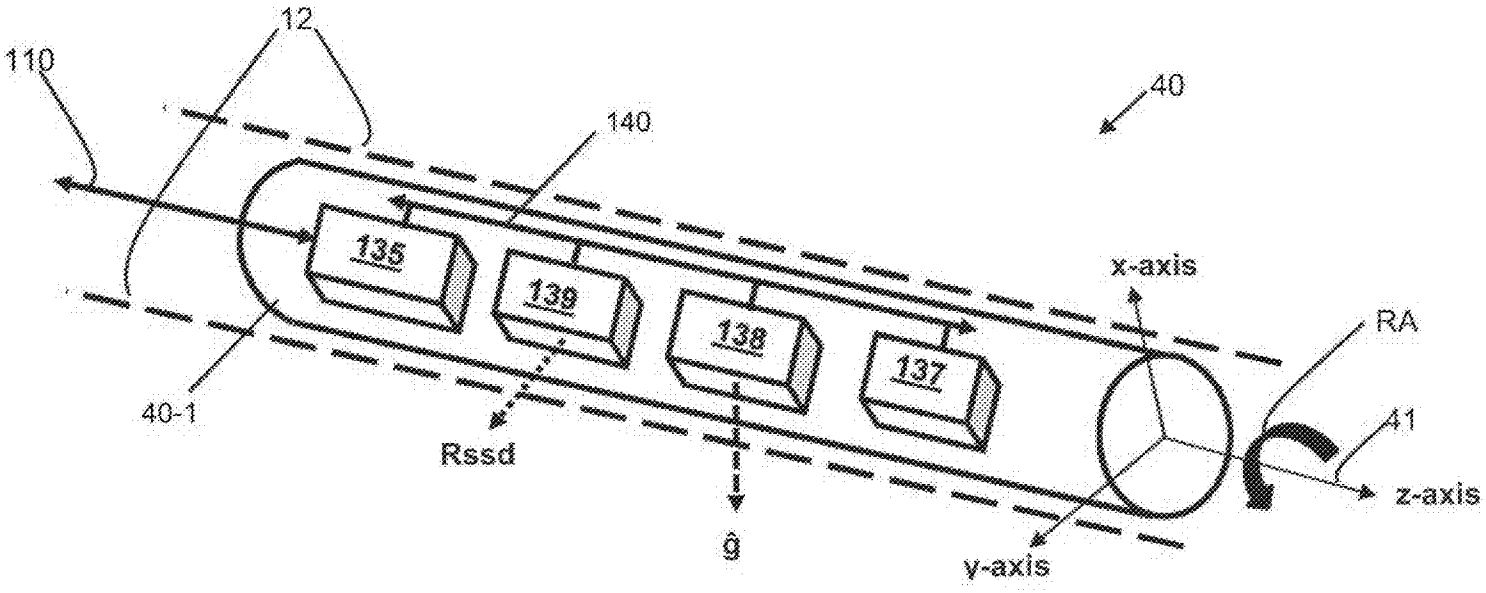
FIG. 3 is a stylized isometric illustration showing the downhole tracking assembly of the system depicted in FIG. 2.

Referring to FIG. 3, a stylized isometric illustration showing the downhole instrument assembly 40 (depicted in FIG. 2) is disclosed. In this view, the tracking instrument assembly 40 is shown in situ, i.e., in the borehole 12. The various modules (135, 137, 138 and 139) are shown as being disposed within a protective housing 40-1. The instrument assembly software defines a Cartesian coordinate system that includes three mutually perpendicular axes (x, y, and z) positioned relative to the instrument assembly 40. Specifically, the z-axis corresponds to the borehole axis 41, the x-axis corresponds to the direction of axle 22 (See FIG. 4), and the y-axis completes the right handed Cartesian (xyz) coordinate system that describes the spatial orientation of the instrument package 40 within the borehole 12. The tracking instrument assembly 40 is disposed at an inclination angle relative to horizontal (See, e.g., FIG. 7) and is rotated at a rotational angle RA about the borehole axis (z-axis). In the one embodiment of the present invention, the instrument package 40 is fastened to the drill stem, so that the Roll Angle RA of the instrument package 40 coincides with that of the drill-stem and is controlled by the driller rotating the drill stem 36. In another embodiment of the present invention, the RA of the instrument package is disposed relative to the drill stem 12 (using a separate motor) between the drill stem 12 and the instrument package 40. The three vector component accelerometer module 138 measures the gravity to thus produce a triad of vector components, gx, gy and gz of the Earth's gravity unit length vector g. (See also FIG. 6). The rotation sensor 139 is rotated about the x-axis to a known position using motor 137. The roll angle RA setting, on the other hand, allows the drilling controller 11 to accurately control the drilling direction (i.e., right/left, up/down). As noted herein, the RA setting may be controlled by the driller 11 (up-hole) or by a separate motor (not shown). The up-hole computer 114 processes the data received from the tracking instrument package 40 disposed down-hole; the processed data allows the drilling controller 11 to accurately guide and operate the drill drilling apparatus 16.

As noted previously, the uphole system 114 manipulates the sensor data provided by the tracking instrument system 40 to calculate the azimuthal direction data, the down-hole unit inclination data and the roll angle RA at each measuring station. (A measuring station is usually defined when new a "joint" of drill pipe, usually about 10 meters in length, is added to the drill stem 36). By determining the borehole azimuthal direction (z-axis), unit inclination and roll, and the known length of drill pipe between measuring stations, the spatial borehole coordinates for each measuring station in the borehole can be precisely and accurately determined.

This information (Az, Inc, and RA) is transmitted to the driller controller 11 so that an appropriate course correction can be made (if necessary).

Table I provided below provides an explanation of the various parameters used herein.

TABLE I

| Parameter | Type | Description |
|---|---|---|
| AAB | Number (Angle) | Angle A to B |
| AbdRssdPerp | Number (Angle) | Angle from bd (bore direction) to RssdPerp |
| AnRssdPerp | Number (Angle) | Angle from North to RssdPerp |
| Az | Number (Angle) | Azimuth. Angle from North (n) to borehole direction (bd) |
| AzRssd | Number (Angle) | Angle from z to Rssd (Rotation Sensor Sensitivity Direction) |
| bd | Vector | Unit vector (bore direction) |
| bdrsg | Coordinate System | Coordinate system defined by bd, rs, g |
| e | Vector | Unit vector perpendicular to g and n |
| ER | Vector | Earth's rotation vector |
| ERg | Number | The magnitude of the projection of ER in the g direction |
| ERn | Number | The magnitude of the projection of ER in the north direction |
| ERPerp | Vector | The projection of ER in the north direction |
| exzuv | Vector | The unit vector of e cross z |
| g | Vector | Unit length gravity vector |
| $g_x$ | Vector | Component of g in x direction |
| $g_y$ | Vector | Component of g in y direction |
| $g_z$ | Vector | Component of g in z direction |
| hs | Vector | High Side. Points up and is perpendicular to z-axis and rs |
| Inc | Number (Angle) | Borehole inclination angle |
| Lat | Number | Latitude |
| n | Vector | Unit vector in the North direction |
| neg | Coordinate System | The coordinate system defined by n, e, and g |
| RA | Number (Angle) | Roll Angle |
| rs | Vector | Unit vector that is horizontal, perpendicular to g and z-axis. Right Side. |
| Rssd | Vector | Rssd is the unit vector pointing in the direction of the sensitivity of the rotation sensor. Rotation Sensor Sensitivity Direction |
| Rssdbd | Number | The magnitude of the projection of Rssd onto the bd-axis |
| Rssdg | Number | The magnitude of the projection of Rssd onto the g-axis |
| RssdPerp | Vector | The horizontal projection of Rssd |
| Rssdrs | Number | The magnitude of the projection of Rssd onto the rs-axis |
| RtoV | Number | Proportionality constant of the sensor relating the voltage output VR to the rotation rate of its sensitivity axis |
| $V_{BIAS}$ | Number | Rotation sensor output bias |
| VR | Number | Voltage output of the sensor |
| $VR_{NEG}$ | Set of Numbers | Set of voltage measurements taken when the sensor is in the second (negative) angle setting |
| VRNegAv | Number | Average of $VR_{NEG}$ |
| $VR_{POS}$ | Set of Numbers | Set of voltage measurements taken when the sensor is in the first (positive) angle setting |
| VRPosAv | Number | Average of $VR_{POS}$ |
| $VR_{RS-}$ | Number | Average of single $VR_{NEG}$ |
| $VR_{RS+}$ | Number | Average of single $VR_{POS}$ |
| x | Vector | Unit vector along x-axis (depicted in FIG. 4) |

TABLE I-continued

| Parameter | Type | Description |
|---|---|---|
| y | Vector | Unit vector along y-axis (as defined in [0030]) |
| z | Vector | Unit vector along borehole axis (z-axis) |

Referring to FIG. 4, a detailed diagram of the rotational sensor module 136 and the motor assembly 137 depicted in FIG. 3 is disclosed. As described herein, these elements are employed to set and to rotate the direction of the sensitivity axis Rssd of the rotation sensor. The motor 137 is included in the instrument assembly 40 to controllably rotate the rotation sensor sensitive direction Rssd to a known orientation angle (AzRssd) relative to the z-axis. The motor 137 is controlled from the up-hole computer 114 via telemetry signals 110. (See, e.g., FIG. 2, up-hole stepper module 114-1).

The rotation sensor 139-1 is mounted in a holder 139-2 that is coupled to the motor 137 via a timing belt 137-1. The motor/belt arrangement is configured to rotate the direction of the sensor's sensitivity direction Rssd about the x-axis (i.e., which corresponds to the axle 139-4). The x-axis is, of course, perpendicular to z-axis, and thus also perpendicular to the sensitivity direction Rssd of the rotation sensor 139-1. The angle AzRssd is thereby precisely set by the program controlling the stepper motor 137. The motor 137 (e.g., a stepper motor) is initialized by aligning a fiduciary mark 139-5 on the sensor holder 139-2 to an encoder sensor 40-3 (e.g., an optical sensor in an optical encoder embodiment) fixed to the body of the instrument 40.

Before entering into the details of the invention, it may be helpful to review the underlying physical and mathematical principles upon which the invention is based.

A rotation sensor, also known as a rate gyroscope, is a device which produces an output voltage in response to being rotated about a sensitivity direction fixed to the device; it produces an output voltage which is proportional to the rate of rotation about this direction. This invention discloses how to determine the azimuth direction of a borehole being drilled using a single vector component rotation sensor together with three vector component gravity sensors. The azimuthal direction of a borehole is defined as the angle from true north to the horizontal projection of the borehole.

If the rotation sensor 139-1 is rotated about an axis, at an angle relative to the sensitivity direction of the sensor 139-1, the voltage produced will be proportional to the cosine of the angle between of the axis of rotation and the sensitivity direction of the sensor and the rate of rotation. The cosine factor is the projection of the rotation sensor sensitivity direction upon the axis about which the sensor itself is rotating. Thus, if the sensor sensitivity direction, Rssd, and the axis of rotation are aligned, the voltage output will be positive and have a maximum positive value (cos 0°=1). If the sensitivity direction of the sensor and the direction of rotation are aligned, but the sense of rotation is in the opposite direction, the output voltage will be negative (cos 180°=−1). Finally if the sensor is rotated about an axis perpendicular to the sensor sensitivity direction, Rssd, there will be no voltage output (cos 90°=0).

Rotation sensors can be so sensitive that they give a measurable output voltage in response to even the rotation of the Earth. Even though a sensor may appear to be at rest to relative to an observer, with respect to inter-stellar space it is still rotating one revolution per day in addition to another revolution per year because the Earth rotates not only about its own axis but also about the sun. This rotation rate of approximately 15°/hour may generate 150 micro-volts from a good, present day rotation sensor. To realize that we are constantly rotating in space we need only observe the stars in the vicinity of the North-Star on a clear evening. At the equator, the North-Star appears on the horizon. In New York City which is at north latitude of 41 degrees, the North Star is at an angle of 41 degrees above the horizon. Looking up at the north-star, the stars in its vicinity, trace out circles in the sky, rotating about the North-Star at the rate of about 15°/hour because we are rotating at about that rate relative to space (360°/hour degrees/day=360°/24 hours=15°/hour.

If the sensitivity direction of the rotational sensor is aligned with the direction to the North-Star, a voltage output of 150 micro-volts will be generated. If the sensitivity direction of the rotation sensor 139-1 is made to point north and horizontal in New York City, the voltage output will be 150*cos (41 degrees)=113 micro-volts, i.e., product of the ratio of the voltage output and rotation rate, and the horizontal projection of the direction to the North Star on the horizontal surface of the Earth. The vertical component of the Earth Rotation vector produces no voltage output from a rotation sensor whose sensitivity direction is horizontal. It is important to note that each vector component of the rotation vector acts on the sensor in an additive manner. In other words, the voltage produced by the sum of two rotation components is the sum of the voltages produced by each of the two components acting separately.

Accordingly, if a rotation sensor in New York has its sensitivity direction horizontal but not perfectly aligned with the North direction (e.g., at an angle of 6 degrees away from North) the sensor's output voltage will be (113 microvolts) (cos 6°), or equal to 112.6 microvolts. Thus, the voltage output of a rotation sensor whose sensitivity direction is nearly aligned with the rotation axis being measured hardly changes. This is because the cosine function changes so slowly near 0 degrees. While a measurement of this type can determine the rate of rotation, it is very unresponsive to misalignments. In other words, it is poor way to determine the angle between North and the sensor sensitivity direction. (For example, note that when the sensor sensitivity direction is 6° away from North, the sensor output voltage is only 0.5% different from the sensor output voltage when the sensor sensitivity direction points north. Moreover, this measurement is not of interest because the horizontal component of Earth's rotation (which points north) is known a priori for all latitudes. (E.g., New York City is known to have rate 15*cos (41° latitude)=11.3 degrees/hour which produces a sensor output of 113 micro-volts. Again, the sensor calibration ratio of volts/rotation rate is known).

If, one the other hand, the sensitivity direction of the sensor points east or west, its voltage output will be zero, since the sensitivity direction is perpendicular to the Earth's Rotation axis and also its horizontal projection direction, i.e., north. If the sensitivity axis of the sensor is horizontal, and points in a direction of 6 degrees from East, the voltage output of the sensor will be 113 microvolts*cos(84°)=12 microvolts. Combining this measurement with the knowledge that the sensor will produce 113 microvolts when the sensitivity axis is aligned with the north direction enables finding the Azimuth angle between the sensitivity axis and north from the relationship: (Azimuth=arccos (12 microvolts/113 microvolts)=84° degrees).

If the rotation sensor sensitivity direction Rssd is not horizontal (i.e., this direction has a vertical component), the vertical component may be computed from the measured gravity direction vector g relative to the instrument package 40. An additional sensor voltage component results from the projection product of this vertical component Rssdg and the known vertical component of Earth's rotation vector ERg. The resulting sensor voltage component can be computed since the voltage gain RtoV of the sensor is known. The residual voltage after subtracting this component from the measured VR represents the Azimuthal angle AnRssdPerp from north to RssdPerp. Since the angle between RssdPerp and the borehole direction bd is known, the angle from north to bd, the Azimuth, is also known.

Before determining the borehole Azimuth, the orientation of the rotation sensor 139 must be set (to apply the method described herein). Typically, the Rssd direction is within approximately 20 degrees of horizontal and is approximately pointed toward East or West (within about 20 degrees). Because of the incremental approach described herein (resetting Rssd with every drill string), the orientation of Rssd is typically very close to being horizontal and East or West. Moreover, this approach tends to minimize the effect of rotation sensor gain variation (e.g., due to temperature effects). When setting (or resetting) Rssd, the instrument package roll angle RA and AzRssd are typically adjusted to optimize the orientation of the rotation sensor Rssd before making measurements. For a given borehole inclination, Inc, and approximate borehole Az, RA and AzRssd can be set to make the direction of Rssd horizontal and East/West. To do so RA is first set (e.g., by the driller) to orient the x axis to be perpendicular to the plane defined by the borehole axis and the expected East/West direction. Then the AzRssd angle controlled by the motor 137 is set to make Rssd parallel and to the East/West directions.

The present invention applies the above principles to make a borehole instrument to determine the Azimuth of the horizontal projection of the borehole direction bd by combining the above principles with measurements of the 3 gravity vector components. Gravity component measurements enable determining borehole inclination, and roll angle with respect to the borehole "z" axis At the outset the approximate borehole direction is known from initial setting of the drilling apparatus 16 and the proposed bore-hole direction 22. Once drilling is underway, the Azimuth determinations and refinements thereof using the method being disclosed are made with great precision typically after every 10 meters of drilling. To set AzRssd before a measurement is made, information of the approximate Azimuth borehole direction will also be used.

Figure 5:
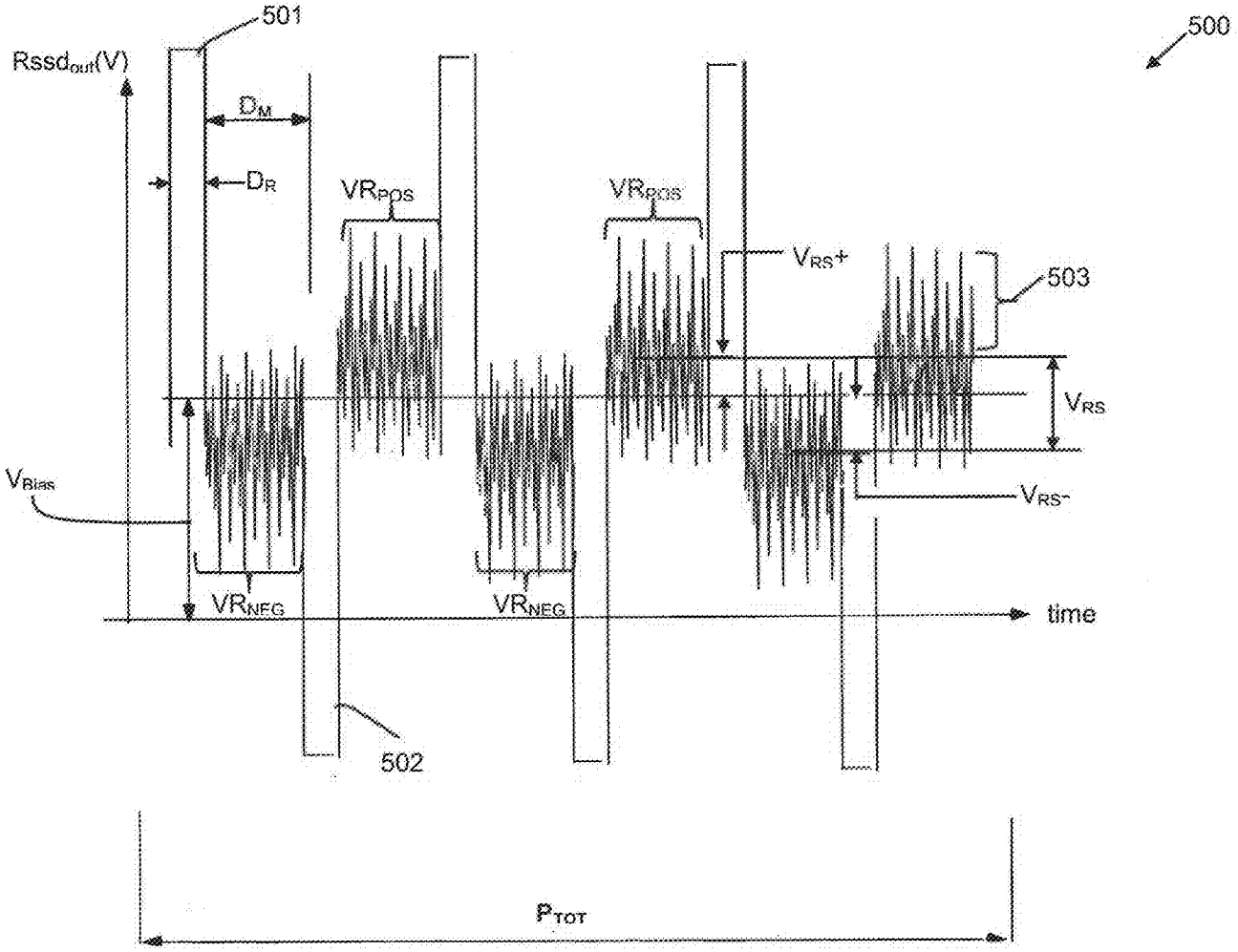
FIG. 5 is a chart illustrating the voltage output of the rotation sensor depicted in FIG. 4.

Referring to FIG. 5, a chart 500 illustrating the voltage output ($Rssd_{OUT}$ (V)) of the rotation sensor depicted in FIG. 4 is disclosed. At the onset of the drilling operation, the initial position of the tracking assembly 40 is known (of course, it corresponds to the initial position/location of the proposed borehole path, i.e., opening 24 at FIG. 1). Based on the exact Latitude of this location, the system performs a calibration operation whereby the position of the rotation sensitivity axis (pointed due East) is calculated (per the encoder). The system 40 completes the calibration by driving the rotational sensor to the calculated encoder position. Once this initial orientation is known, the system obtains a single vector component measurement of the Earth's rotation vector (after the drilling stops to e.g., add drill string) to determine an azimuthal adjustment to the borehole direction (to thus maintain course).

In reference to FIGS. 1, 3 and 5, various measurements are made after drilling has stopped and the drill stem 36 and instrumentation assembly 40 are at rest. In the rest position, the drill stem 36 is slowly rotated to bring the roll angle RA of the instrument assembly 40 to make the x axis perpendicular to the expected East/West direction. The AzRssd is set by motor 137 to make Rssd point in the expected East or West direction (relative to a predetermined location on the drill stem). To be specific, the rotation sensor sensitivity axis Rssd is made to point alternately between approximately east/west directions during measurements.

The rotation sensor voltage measurements made at a first angle setting are defined as $VR_{POS}$. An ensemble of $VR_{POS}$ earth rotation measurements are made while holding the sensor steady during a measurement period ($D_M$). Those skilled in the art will appreciate that the measurement period is a function of the rotational sensor 139 itself. In one embodiment, period $D_M$ is, e.g., about 15 seconds. During a sensor rotation operation 501, the stepper motor 137 rotates the sensor angle AzRssd by 180 degrees (See negative direction Rssd− at FIG. 4). The sensor rotation period ($D_R$) is a function of the rotational sensor 139 itself. (In one embodiment, $D_R$ may take approximately one (1) second). After this, the sensor 139-1 is again steadied so that a second ensemble of earth rotation measurements $VR_{NEG}$ is taken during the next measurement period ($D_M$). During a subsequent sensor rotation operation 502, the motor 137 rotates the sensor angle AzRssd by 180 degrees to position the sensor 139 for a $VR_{POS}$ measurement ensemble. Measurements of $VR_{POS}$ and $VR_{NEG}$ are made over and over again during a total sensor measurement time period ($P_{TOT}$), which may take, for example, about a few minutes. Thus, during the total measurement time period ($P_{TOT}$), the sensor direction Rssd is rotated back and forth between the positive and negative angle settings of the rotation sensor 139. All the positive measurements $VR_{POS}$ are averaged to produce VRPosAv; and all of the negative values $VR_{NEG}$ are averaged to produce VRNegAv. These averages are used to eliminate the rapidly varying sensor noise 503. VRNegAv is then subtracted from VRPosAv to eliminate sensor bias ($V_{BIAS}$) to produce the voltage VR which is based on the Earth's rotation.

$$VR = VRPosAv - VRNegAv \tag{1}$$

VR is twice the voltage output $V_{RS}$+ or $V_{RS}$− produced from the Earth's rotation during each of these periods.

The precision of these measurements varies with the square root of the total averaging time (PTOT FIG. 5). In an alternate embodiment of the present invention, to enhance the precision of VR an ensemble of essentially identical sensors can be ganged together. The individual sensor voltages are then averaged together thereby producing a VR of specified precision in a time inversely related to the number of sensors ganged together. The embodiment described herein, for simplicity and cost reasons, uses only a single rotation sensor.

Figure 6:
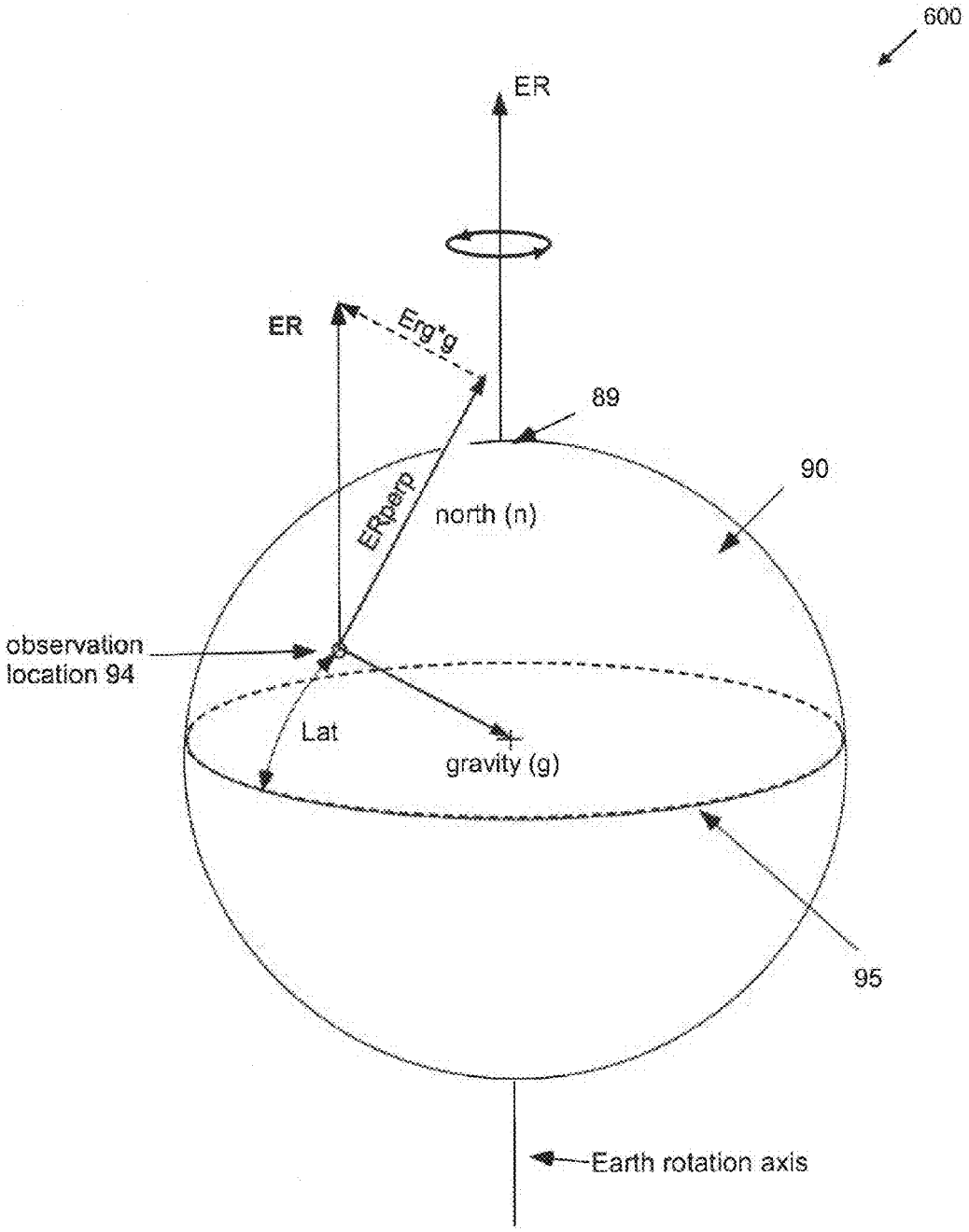
FIG. 6 is a diagrammatic illustration of the Earth showing, inter alia, the relationship between the Earth rotation vector ER, gravity vector g and the north direction.

Referring to FIG. 6, a diagrammatic illustration 600 of the Earth 90 showing, inter alia, the relationship between the Earth's rotation vector (ER), gravity vector (g) and the north direction (n) is disclosed. FIG. 6 also shows the Earth 90 relative to the North Pole 89 and the Equator 95. Comparing FIGS. 5 and 6, note that the sensor voltage VR is proportional to the projection of sensor rotation vector rate ER upon the sensor's direction of sensitivity Rssd. When the sensor is held steady, the rotation rate to which the sensor is subject is the Earth's rotation vector ER (FIG. 6). Thus the voltage VR can be written as:

$$VR = 2*RtoV*\mathrm{dot}(ER, Rssd) \tag{2}$$

The output voltage VR represents the single vector component measurement of the Earth's rotation vector, since the dot product is a projection of the Earth Rotation vector onto the sensitivity axis Rssd of the rotational sensor 139.

Note that RtoV is the proportionality constant of the sensor relating the voltage output VR to the sensor rotation rate about its sensitivity axis Rssd. Rssd is the unit vector pointing in the direction of the sensitivity of the rotation sensor 139-1. The data analysis provided below shows that a good choice for the direction of Rssd is approximately east/west and horizontal. As noted above, the azimuth of the borehole being drilled is exactly determined during the initial setup of the drilling apparatus 16 (at the proposed borehole path 20), and then known approximately thereafter, from measurements taken during the previous stage of drilling. The driller monitors the direction of drilling and drill-stem rotational orientation roll angle RA and sets Rssd to an optimal direction. Note also that the north direction, represented by the unit vector n, is the direction of the horizontal projection of the Earth's rotation vector ER. At the same time and measuring depth, the outputs gx, gy and gz of the accelerometer which represent the x, y and z components of the gravity unit vector are also made. (The module 114-4 is configured to relate these measurements and the rotation sensor orientation to the driller 11).

Figure 7:
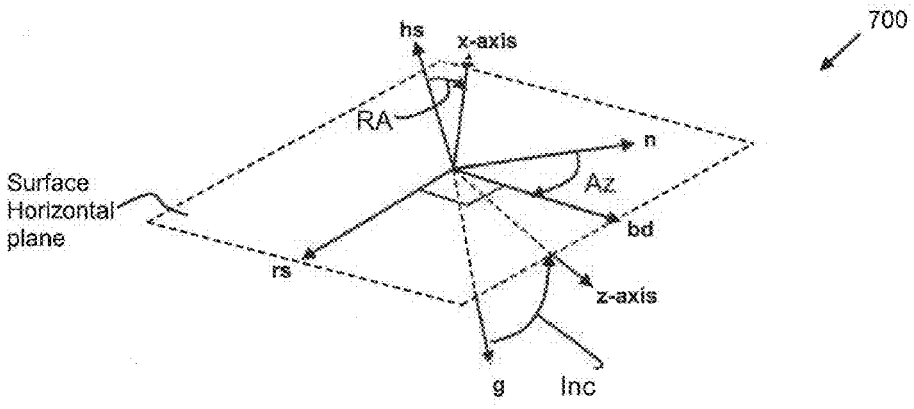
FIG. 7 is a diagrammatic illustration showing a three-dimensional coordinate system that provides a spatial relationship between the borehole axis, borehole inclination, roll angle and the borehole azimuth.

Referring to FIG. 7, a diagrammatic illustration 700 showing a three-dimensional coordinate system that provides a spatial relationship between the borehole axis (z), borehole inclination, roll angle and the borehole azimuth is disclosed. This is a detail view of FIG. 6 and illustrates the relationship between the borehole axis z, the borehole azimuthal direction (Az), the borehole inclination (Inc) and the "bdrsg" coordinate system. Specifically, the "bd" shown in FIG. 7 is perpendicular to the gravity vector (g) and approximately rotational sensor sensitivity direction vector Rssd.

The accelerometer data are in the form of voltages which represent the vector components gx, gy and gz of the unit gravity direction g. Note that the Earth's surface can be approximated as a plane perpendicular to g. The unit vector rs is in this plane, which is horizontal and perpendicular to both the z-axis (borehole drilling axis) and the gravity unit vector (g), and is given by the vector cross product:

$$rs = (\mathrm{cross}(g,z))/|\mathrm{cross}(g,z)| \tag{3}$$

$$g = gx*x + gy*y + gz*z \tag{4}$$

$$z = 0*x + 0*y + 1*z \tag{5}$$

The terms x, y and z are unit vectors defined with respect to the instrument assembly 40. The unit vector rs (right side) points to the right looking down the z-axis (borehole axis) 41. The vector rs will thus have no vector component in either the z or g directions.

Another unit vector, the borehole direction bd is defined by:

$$bd = \mathrm{cross}(rs, g) \tag{6}$$

The vector bd is a horizontal unit vector; and specifically, it is the projection of the borehole drilling axis z onto the horizontal plane. The three unit vectors bd, rs and g define the "bdrsg" right handed coordinate system. The inclination angle Inc of the borehole axis is given by:

$$\mathrm{Inc} = a\tan 2(\mathrm{sqrt}(gx\hat{}2 + gy\hat{}2), gz) \tag{7}$$

The term a tan 2 is the 4 quadrant inverse tangent function.

Another important unit vector, from which the roll angle RA is found is:

$$hs = \mathrm{cross}(rs, z) \tag{8}$$

The hs unit vector points up and is perpendicular to the borehole axis z and to the right side vector rs. The roll angle RA of the instrument assembly 40 and the drill stem 36 to which it is fastened is given by:

$$RA=a\tan 2(\mathrm{dot}(x,rs),\mathrm{dot}(x,hs)) \quad (9)$$

Based on the sensor output of the accelerometer unit 138 (FIGS. 2-3), the system software, as articulated above, has determined the projection of the borehole drilling axis onto the horizontal plane (bd), the roll angle (RA) of the instrument assembly 40, and the inclination angle (Inc) of the borehole axis 41 (i.e., the z-axis) relative to the horizontal surface plane.

Next, the software of the present invention is configured to determine the azimuthal direction of the borehole projection (bd). Referring back to FIG. 4, data pertaining to the rotation sensor 139-1, motor 137, encoder 40-3 and fiduciary mark 139-5 (on sensor holder 139-2) are employed to determine the azimuth direction of the borehole direction bd. The rotation angle AzRssd shown in FIG. 4, i.e., the angle defining the sensitivity direction of the rotation sensor 139-1 relative to the z-axis, is given by:

$$Rssd=0*x+\sin(AzRssd)*y+\cos(AzRssd)*z \quad (10)$$

$$AzRssd=a\tan 2(\sin(AzRssd),\cos(AzRssd)) \quad (11)$$

The angle from the z-axis to Rssd, AzRssd is given by data from the encoding of the motor 137, and from data provided by the encoder 40-3 and fiduciary mark 139-5. Before taking a measurement the angles RA and AzRssd must be set such that Rssd is pointing approximately horizontal and East/West. These angles are found using the azimuth and inclination from the previous measurement in the north-east-gravity (neg) coordinate system.

$$e=\mathrm{cross}(g,n) \quad (12)$$

$$bd=\cos(Az)*n+\sin(Az)*e \quad (13)$$

$$z=\cos(\mathrm{Inc})*g+\sin(\mathrm{Inc})*bd \quad (14)$$

$$rs=\mathrm{cross}(g,z) \quad (15)$$

$$hs=\mathrm{cross}(rs,z) \quad (16)$$

$$exzuv=\mathrm{cross}(e,z)/|\mathrm{cross}(e,z)|(\text{unit vector in direction of } e \text{ cross } z) \quad (17)$$

$$RA=a\tan 2(\mathrm{dot}(exzuv,rs),\mathrm{dot}(exzuv,hs)) \quad (18)$$

$$AzRssd=a\tan 2(|\mathrm{cross}(e,z)|,\mathrm{dot}(e,z)) \quad (19)$$

The vector components of Rssd in the horizontal bdrsg coordinate system are given by:

$$Rssdbd=\mathrm{dot}(Rssd,bd) \quad (20)$$

$$Rssdrs=\mathrm{dot}(Rssd,rs) \quad (21)$$

$$Rssdg=\mathrm{dot}(Rssd,g) \quad (22)$$

The vectors Rssd, bd, rs, and g in Eq. 20, 21 and 22 are expressed in their xyz representation, i.e., Eqs. 3, 4, 5 and 6. For computational purposes these three expressions can be useful. Rssdbd, Rssdrs and Rssdg are also expressible in terms of the angles RA, Inc and AzRssd as:

$$Rssdbd=\sin(\mathrm{Inc})*\cos(AzRssd)-\cos(\mathrm{Inc})*\sin(AzRssd)*\sin(RA) \quad (23)$$

$$Rssdrs=\cos(RA)*\sin(AzRssd) \quad (24)$$

$$Rssdg=\cos(\mathrm{Inc})*\cos(AzRssd)+\cos(\mathrm{Inc})*\sin(RA)*\sin(AzRssd) \quad (25)$$

$$AbdRssdPerp=a\tan 2(Rssdrs,Rssdbd) \quad (26)$$

Referring to FIG. 7, a three-dimensional coordinate system that provides a spatial relationship between the borehole axis, borehole inclination, roll angle and the borehole azimuth is disclosed. Specifically, the borehole azimuth is the angle (Az) from north direction (n) to the horizontal projection of the borehole drilling direction bd. As shown in FIG. 6, the north direction (n) is the direction of the horizontal projection of the Earth's rotation vector ER. Moreover, at a surface location 94 with known latitude angle (Lat) from the equator 95, the Earth's rotation vector ER can be written as the sum of two parts, a vertical part in the direction of gravity g given by ERg*g and a horizontal part ERPerp, i.e., ERn*n, pointing in the north direction, $$ER=ERPerp+ERg*g=ERn*n+ERg*g \quad (27)$$

$$ERn=|ER|*\cos(\mathrm{Lat}) \quad (28)$$

$$ERg=-|ER|*\sin(\mathrm{Lat}) \quad (29)$$

The signs of the component values in Eq. 3 are for locations in the northern hemisphere, i.e., positive latitude. The values in the southern hemisphere can be similarly computed. As before, the vector g is a unit vector pointing down. ERg is the projection of ER in the g direction i.e., ERg=dot(ER, g). The value of the magnitude of the Earth's rotation vector |ER| is 15.04 degrees/hour.

Figure 8:
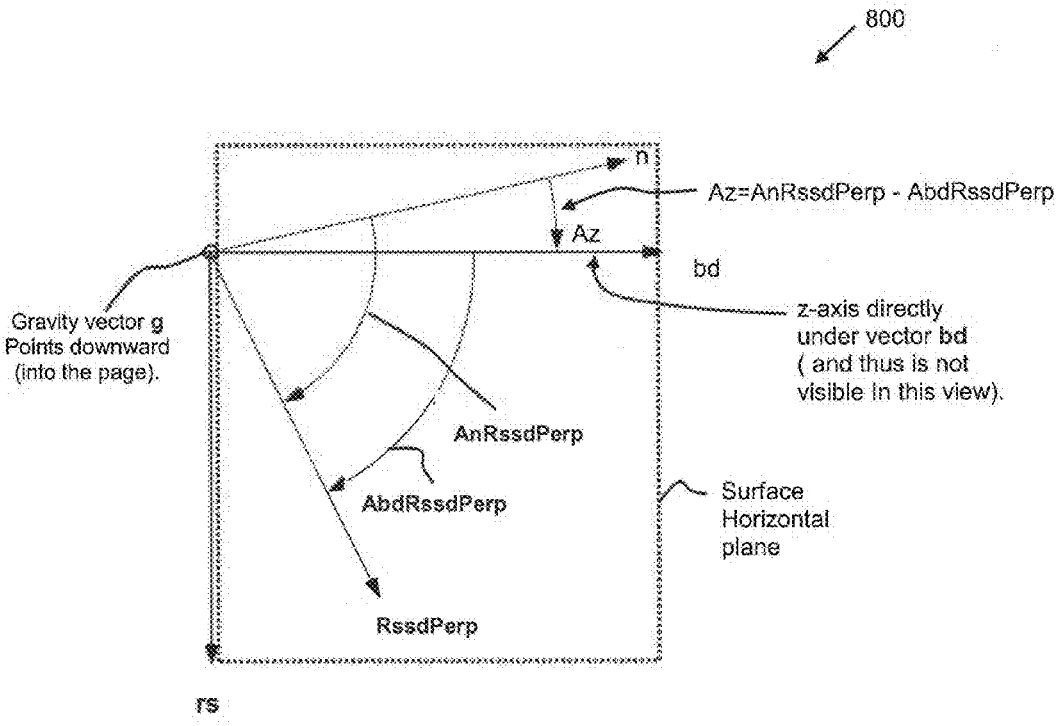
FIG. 8 is a diagrammatic illustration showing the angular relationship between the borehole azimuth angle and the angle of the horizontal projection of the rotation sensitivity axis.

Referring to FIG. 8, a diagrammatic illustration 800 showing the angular relationship between the borehole azimuth angle (Az) and the angle of the horizontal projection of the rotation sensitivity axis (RssdPerp) is disclosed. Since the vectors bd and rs are in the horizontal plane, FIG. 8 is a plan view or the Earth's surface. Thus, the gravity vector g points into the page and the z-axis is hidden under vector bd.

Note that the unit vector Rssd, which points in the direction of the rotation sensor sensitivity direction 139-1 (FIG. 4), can also be decomposed into a part in the g direction, i.e., Rssdg*g, and a part perpendicular to g, i.e., RssdPerp (which is disposed in the horizontal plane):

$$Rssd=RssdPerp+Rssdg*g \quad (30)$$

In reference to FIG. 5, note that RssdPerp, ERPerp, Rssdg and ERg are all a function of the voltage VR (generated by rotational sensor 139-1). An expression for the voltage VR can be derived by inserting Eq. 3 and Eq. 4 into Eq. 2 (note that g and RssdPerp are perpendicular to each):

$$VR=2*RtoV*(\mathrm{dot}(RssdPerp,ERPerp)+ERg*Rssdg) \quad (31)$$

$$VR=2*RtoV*\mathrm{dot}(RssdPerp,ERPerp)+2*RtoV*ERg*Rssdg \quad (32)$$

Those skilled in the art will recognize that equations (31-32) are identical to equation (2), i.e., they represent the single vector component measurement of the Earth's rotation vector. However, these equations use the distributive property to show the dot product of equation (2) using the horizontal (north) and vertical (gravity) parts of these vectors (i.e., ER, Rssd). Rearranging terms in Eq. 32 gives $$\mathrm{dot}(RssdPerp,ERn*n)=VR/(2*RtoV)-ERg*Rssdg \quad (33)$$

As those skilled in the art will appreciate, the dot product of any two vectors A and B can also be defined by:

$$\mathrm{dot}(A,B)=|A|*|B|*\cos(AAB) \quad (34)$$

Where, |A| and |B| are the magnitudes of the vectors A and B and AAB is the angle between A and B. Using this definition of the dot product, the function Eq. 34 can be written:

$$\text{dot}(RssdPerp, ERn*n) = |RssdPerp|*|ERn|*\cos(AnRssdPerp) \quad (35)$$

AnRssdPerp is the angle from North (n) to RssdPerp. Solving Eq. 35 for cos (AnRssdPerp) gives:

$$\cos(AnRssdPerp) = (VR/(2*RtoV) - ERg*Rssdg)/(|RssdPerp|*|ERn|) \quad (36)$$

Using the inverse cosine function arccos gives:

$$AnRssdPerp = \arccos((VR/(2*RtoV) - ERg*Rssdg)/(|RssdPerp|*|ERn|) \quad (37)$$

Since the function cos(A) is an 'even' function of A, i.e., cos(A)=cos(−A), Eq. 37 has two solutions, i.e., either the angle A or −A. The computer implementation of the arccos function returns the solution for A between 0 and π radians, i.e., 0 and 180 degrees. Since the direction of Rssd was set to be approximately "easterly", AnRssdPerp is approximately 90 degrees. If Rssd points westerly, the negative branch of the arccos function is applicable.

Thus the azimuth angle Az from north to the borehole direction is given by:

$$Az = AnRssdPerp - AbdRssdPerp \quad (38)$$

Figure 9:
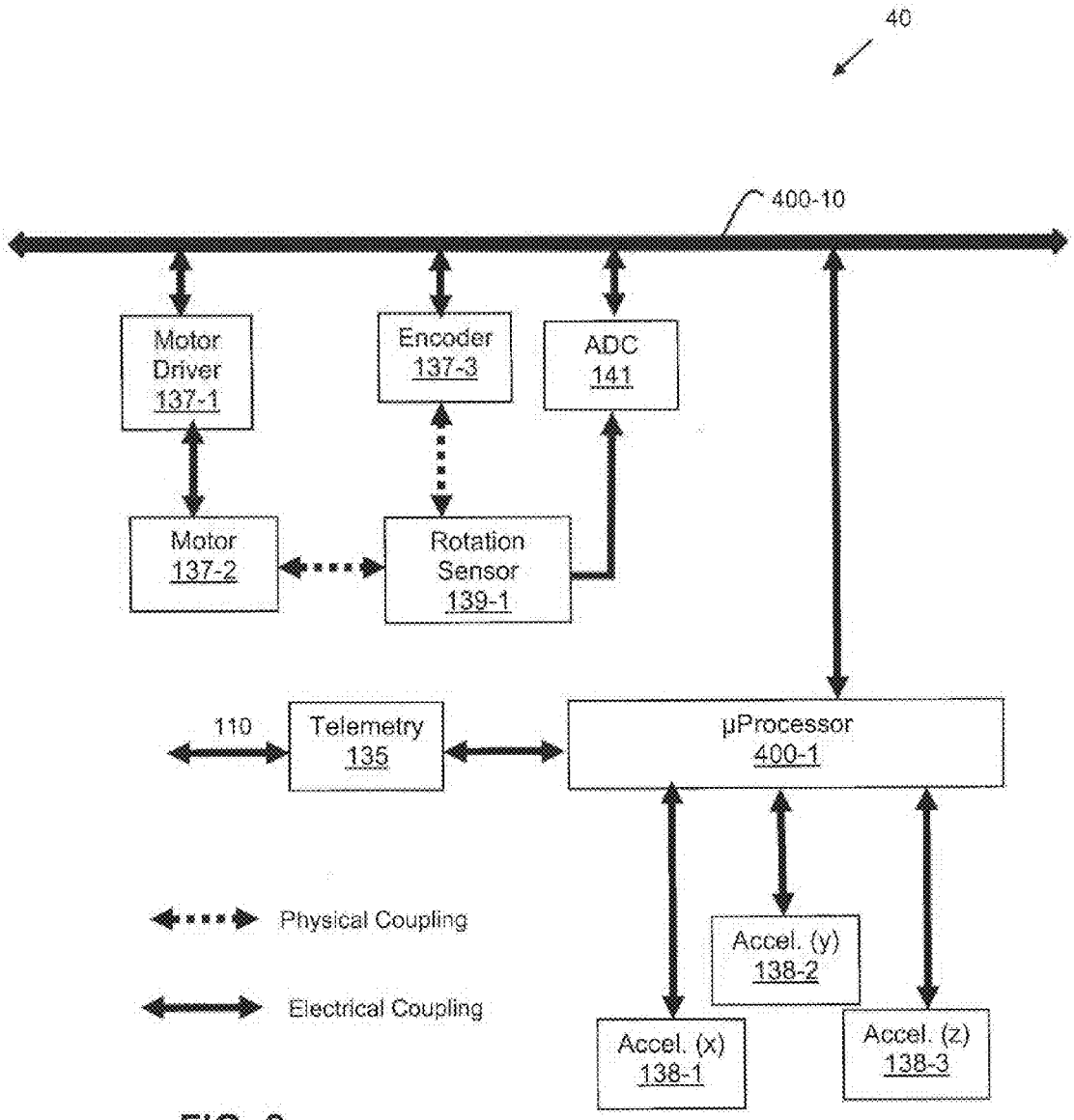
FIG. 9 is a detail diagram of the downhole tracking assembly.

Referring to FIG. 9, a detail diagram of the downhole tracking assembly is disclosed. In this embodiment, a microprocessor 400-1 is coupled to the telemetry circuit 135, a motor driver 137-1 and an encoder 137-3 via a system bus 400-10. Accordingly, the microprocessor 400-1 is configured to bi-directionally communicate with the various components coupled to the bus 400-10. In this embodiment, the microprocessor 400-1 may include on-board analog-to-digital conversion (ADC) channels that accommodate the analog output signals of the accelerometers (138-1, 138-2, 138-3). The analog output signal of the rotational sensor 139-1 may be converted to a digital signal by an ADC (141-1) (See, e.g., FIG. 9).

The sizing and selection of the microprocessor 400-1 is considered to be within the skill of one of ordinary skill in the art with the following proviso; obviously, if the functionality of the up-hole control system is incorporated into the down-hole system, the computational burden of the resultant processor will be greater. However, in accordance with the embodiment of FIG. 2, the microprocessor 400-1 may be implemented using any suitable processing device depending on processing speed, cost, and durability considerations. In one embodiment, therefore, processor 400-1 may be implemented using a 32-bit microcontroller coupled to any suitable computer readable media. As noted above, the microcontroller may be more or less powerful depending on cost/processing speed considerations.

The term "computer-readable medium" as used herein refers to any medium that participates in providing data and/or instructions to the processor 400-1 for execution. Such a medium may take many forms, including but not limited to RAM, PROM, EPROM, EPROM, FLASH-EPROM or any suitable memory device, either disposed on-board the processor 400-1 or provided separately. In one embodiment, the processor 400-1 may include 256 KB of flash memory and 32 KB of SRAM.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; inventive embodiments may be practiced otherwise than as specifically described and claimed.

All references, including publications, patent applications, and patents, cited herein are hereby incorporated by reference to the same extent as if each reference were individually and specifically indicated to be incorporated by reference and were set forth in its entirety herein.

All definitions, as defined and used herein, should be understood to control over dictionary definitions, definitions in documents incorporated by reference, and/or ordinary meanings of the defined terms.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A system comprising:

a first sensor assembly coupled to a mobile platform configured to traverse a predetermined path under a surface of the Earth and further characterized by an axis of motion corresponding to a path direction of the predetermined path, the first sensor assembly being configured to obtain a gravity vector of the Earth relative to the mobile platform;

a second sensor assembly coupled to the first sensor and disposed in substantial alignment with a predetermined position relative to the axis of motion, the second sensor being characterized by a sensitivity axis and further configured to provide a sensor signal substantially corresponding to a single vector component of the Earth's rotation vector; and a control system coupled to the first sensor assembly and the second sensor assembly, the control system being configured to derive the path direction relative to a known direction and an inclination angle of the mobile platform relative to the surface based on the gravity vector and the single vector component of the Earth's rotation vector.

2. The system of claim 1, wherein the sensor signal substantially corresponds to a sensor sensitivity vector pointing in the direction of the sensitivity axis.

3. The system of claim 1, wherein the mobile platform is selected from a group of mobile platforms including a borehole forming apparatus, a drilling apparatus, a tunneling apparatus, and a submersible apparatus.

4. The system of claim 1, wherein the traversal of the predetermined path includes drilling a borehole under the surface.

5. The system of claim 4, wherein the axis of motion substantially corresponds to a longitudinal axis of the borehole.

6. The system of claim 5, wherein the first control system and the second control system are coupled together by a telemetry system, the telemetry system being configured to transmit second data corresponding to the gravity vector and the single vector component of the Earth's rotation vector from the second control system to the first control system, the telemetry system being configured to transmit first data corresponding to mobile platform guidance data from the first control system to the second control system.

7. The system of claim 1, wherein the control system includes a first control system disposed at the surface of the Earth and a second control system coupled to the mobile platform.

8. The system of claim 1, wherein the second sensor assembly includes a rotational sensor configured to be moved to a predetermined direction relative to the axis of motion, the movement to the predetermined direction including at least one rotational movement.

9. The system of claim 8, wherein the second sensor assembly includes a positional encoding device coupled between the rotational sensor and a motor, the motor being configured to rotate the rotational sensor to a position substantially aligned with the predetermined direction based on positional data provided by the positional encoding device.

10. The system of claim 8, wherein the at least one rotational movement includes a roll angle component.

11. The system of claim 1, wherein the sensor signal substantially corresponds to, VR=2*(RtoV)*dot(ER, Rssd), wherein RtoV is a constant relating the sensor signal to a rotation rate of the sensitivity axis, ER is the Earth's rotation vector, Rssd is a unit vector pointing in a direction of the sensitivity axis, and dot(ER, Rssd) is a dot product configured to project ER onto Rssd.

12. The system of claim 1, wherein the inclination angle substantially corresponds to, Inc=a tan 2(sqrt(gx^2+gy^2), gz) wherein term a tan 2 is the four-quadrant inverse tangent function, and gx, gy, gz correspond to three-gravity vector components of the gravity vector.

13. The system of claim 1, wherein the path direction substantially corresponds to an azimuth direction.

14. The system of claim 13, wherein the azimuth direction substantially corresponds to, Az=AnRssdPerp−AbdRssdPerp, wherein the term Az substantially corresponds to an angle between the known direction and the path direction, and wherein the term AnRssdPerp substantially corresponds to an angle between the known direction and a component of the sensitivity axis, and wherein the term AbdRssdPerp substantially corresponding to an angle between the path direction and the component of the sensitivity axis, AnRssdPerp and AbdRssdPerp being substantially derived from the sensor signal.

15. The system of claim 1, wherein the known direction is North.

16. A method comprising: providing a mobile platform configured to traverse a predetermined path under a surface of the Earth, the mobile platform being further characterized by an axis of motion corresponding to a path direction of the predetermined path; obtaining a gravity vector of the Earth relative to the mobile platform; sensing a single vector component of the Earth's rotation vector relative to the mobile platform; providing a sensor signal substantially corresponding to the single vector component of the Earth's rotation vector; and deriving the path direction relative to a known coordinate and an inclination angle of the mobile platform relative to the surface based on the gravity vector and the single vector component of the Earth's rotation vector.

17. The method of claim 16, wherein the sensor signal is provided by a rotational sensor characterized by sensitivity axis, the sensor signal substantially corresponding to a sensor sensitivity vector pointing in the direction of the sensitivity axis.

18. The method of claim 16, wherein the mobile platform is selected from a group of mobile platforms including a borehole forming apparatus, a drilling apparatus, a tunneling apparatus, and a submersible apparatus.

19. The method of claim 16, wherein the traversal of the predetermined path includes drilling a borehole under the surface.

20. The method of claim 16, wherein the axis of motion substantially corresponds to a longitudinal axis of the borehole.

21. The method of claim 16, further comprising the step of transmitting platform data corresponding to the gravity vector and the single vector component of the Earth's rotation vector from the mobile platform to a remotely located system.

22. The method of claim 21, further comprising the step of transmitting guidance data from the remotely located system to the mobile platform.

23. The method of claim 16, further comprising the step of moving a rotational sensor to a predetermined direction relative to the axis of motion, the movement to the predetermined direction including at least one rotational movement.

24. The method of claim 23, further comprising the step of rotating the rotational sensor to a position substantially aligned with the predetermined direction based on positional data provided by a positional encoding device.

25. The method of claim 23, wherein the at least one rotational movement includes a roll angle component.

26. The method of claim 16, wherein the sensor signal substantially corresponds to, VR=2*(RtoV)*dot(ER, Rssd), wherein RtoV is a constant relating the sensor signal to a rotation rate of the sensitivity axis, ER is the Earth's rotation vector, Rssd is a unit vector pointing in a direction of the sensitivity axis, and dot(ER, Rssd) is a dot product configured to project ER onto Rssd.

27. The method of claim 16, wherein the inclination angle substantially corresponds to, Inc=a tan 2(sqrt(gx^2+gy^2), gz) wherein term a tan 2 is the four-quadrant inverse tangent function, and gx, gy, gz correspond to three-gravity vector components of the gravity vector.

28. The method of claim 16, wherein the path direction substantially corresponds to an azimuth direction.

29. The method of claim 28, wherein the azimuth direction substantially corresponds to, Az=AnRssdPerp−AbdRssdPerp, wherein the term Az substantially corresponds to an angle between the known direction and the path direction, and wherein the term AnRssdPerp substantially corresponds to an angle between the known direction and a component of the sensitivity axis, and wherein the term AbdRssdPerp substantially corresponding to an angle between the path direction and the component of the sensitivity axis, AnRssdPerp and AbdRssdPerp being substantially derived from the sensor signal.

30. The method of claim 29, wherein the known direction is north.

31. The method of claim 16, wherein the known direction is north.

* * * * *